US007464745B2

(12) United States Patent
Tamura et al.

(10) Patent No.: US 7,464,745 B2
(45) Date of Patent: Dec. 16, 2008

(54) METAL MOLD CASTING DEVICE USING METAL COPE AND METAL DRAG AND DEVICE FOR MOVING METAL COPE RELATIVE TO METAL DRAG

(75) Inventors: Takahiro Tamura, Toyokawa (JP); Fumikazu Shiose, Toyokawa (JP)

(73) Assignee: Sintokogio Ltd., Aichi-Ken (JP)

( * ) Notice: Subject to any disclaimer, the term of this patent is extended or adjusted under 35 U.S.C. 154(b) by 37 days.

(21) Appl. No.: 11/547,713

(22) PCT Filed: Apr. 30, 2004

(86) PCT No.: PCT/JP2004/005834

§ 371 (c)(1),
(2), (4) Date: Oct. 6, 2006

(87) PCT Pub. No.: WO2005/099932

PCT Pub. Date: Oct. 27, 2005

(65) Prior Publication Data

US 2007/0199675 A1 Aug. 30, 2007

(30) Foreign Application Priority Data

Apr. 8, 2004 (JP) ..... 2004-113742
Apr. 9, 2004 (JP) ..... 2004-115835

(51) Int. Cl.
*B22D 33/04* (2006.01)

(52) U.S. Cl. ..... 164/339; 164/342; 164/347

(58) Field of Classification Search ..... 164/137, 164/339, 342–344, 347
See application file for complete search history.

(56) References Cited

U.S. PATENT DOCUMENTS 5,035,606 A * 7/1991 Zakich ..... 425/569

FOREIGN PATENT DOCUMENTS

| | | | |
|---|---|---|---|
| JP | 61238456 A | * | 10/1986 |
| JP | 62044418 A | * | 2/1987 |
| JP | 62158559 A | * | 7/1987 |
| JP | 63-184643 | | 11/1988 |
| JP | 63-273561 | | 11/1988 |
| JP | 4-270055 | | 9/1992 |

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A device for moving a metal cope towards and apart from a stationary metal drag, used in a metal mold casting device that uses the metal cope and drag, comprising: an upper die plate (9) for carrying the metal cope; a frame (5; 25); a metal mold opening and closing device (6) mounted on the frame for carrying and vertically moving the upper die plate relative to the frame so as to move the metal cope attached to the upper die plate between a position that is above and relatively near the metal drag and a position that is at the metal drag; and an actuator (3; 23, 23) connected to the frame for moving the frame so as to move the metal cope attached to the upper die plate between the position that is above and relatively near the metal drag and a position that is relatively far from the metal drag.

7 Claims, 5 Drawing Sheets

METAL MOLD CASTING DEVICE USING METAL COPE AND METAL DRAG AND DEVICE FOR MOVING METAL COPE RELATIVE TO METAL DRAG

TECHNICAL FIELD

This invention relates to a device for moving a metal cope relative to a metal drag, for use in a metal mold casting device that uses a horizontal-split-type mold made of the metal cope and drag.

BACKGROUND ART

JP 63-273561A discloses such a metal mold casting device provided with a device for moving a metal cope relative to a metal drag. In this metal mold casting device the split-type mold is opened by vertically moving an upper die plate that carries the metal cope, relative to the metal drag by an upwardly-facing cylinder disposed above the upper die plate. In this cope-moving device the upper die plate vertically travels a long distance, and four supports for guiding the upper die plate are long. Thus the height of the metal mold casting device is great. Thus the guiding supports tend to deflect when subjected to a great load. Further, since the supports are subjected to a great force and deflect when the metal cope and drag are separated after pouring, the metal cope shifts horizontally, thereby causing an as-cast product, which is raised together with the cope, to interfere the metal drag and hence to be damaged. In addition to this problem, there is another problem that the coating applied to the drag is peeled off. These problems are notable if the mold has a plurality of molding cavities or a complicated molding cavity.

Further, since the upper die plate vertically travels a long distance, the hydraulic cylinder and the hydraulic unit must have a large capacity, and hence they will be large in size and expensive.

The present invention has been conceived in view of those problems discussed above. The purpose of the invention is to provide a device for moving a metal cope relative to a metal drag and to provide a metal mold casting device using the device for moving the metal cope that can reduce its height required for a working space for setting a core and taking out the product, that can reduce the damage of the product and the peeling-off of the coating due to the lateral shift of the metal cope caused when the cope is separated from the drag, and than can minimize the draft of the mold.

SUMMARY OF THE INVENTION

To the above end, a device of the invention for moving a metal cope towards and apart from a stationary metal drag, used in a metal mold casting device that uses the metal cope and drag, comprises an upper die plate for carrying the metal cope; a frame; a metal mold opening and closing device mounted on the frame for carrying and vertically moving the upper die plate relative to the frame so as to move the metal cope attached to the upper die plate between a position that is above and relatively near the metal drag and a position that is at the metal drag; and an actuator connected to the frame for moving the frame so as to move the metal cope attached to the upper die plate between the position that is above and relatively near the metal drag and a position that is relatively far from the metal drag.

In the device of the invention having the structure described above, the cope is moved from the drag by a specific or minimum distance required to separate the cope from the drag (the distance between the position that is just above the drag and the position that is at the drag), i.e., by a small stroke. Thus the device will be stable without causing the cope to shift laterally but causing it to open with high precision, thereby reducing the damage of the product and the peeling-off of the coating and providing the minimum draft of the mold.

The present invention also provides a metal mold casting device that is rigid, compact, and has a relatively low profile, by using the device of the invention for moving the cope.

Since in the present invention the metal cope is moved between the position that is just above the drag and the position that is relatively far from the drag, or the cope is sufficiently spaced apart from the drag at a large stroke, a sufficient working space is provided therebetween. The low-profile device and this additional advantage of the sufficient working space enable one to more easily clean the mold, check the coating, and set a core or cores.

The present invention can be applied to the gravity die casting, where molten metal is introduced into the mold from a holding furnace through a stalk by pressurizing the inner space of the holding furnace under a low pressure, and to the low pressure die casting, where molten metal is introduced into the mold by gravitation.

Also in the present invention the cope is moved away from the drag in two stages or steps, i.e., a small movement (a small stroke) and a large movement (a large stroke). The small movement may be carried out at a low speed, and the large movement at a high speed, as required.

Since in one aspect of the present invention the actuator rotates the frame that carries the upper die plate so as to move the metal cope, which is secured the die plate, to a position located at the outside of the metal drag, an open space is provided above the drag. Thus a crane can hoist both the cope and drag, thereby making it easy to change the cope and drag and shortening the time required for that changing.

DESCRIPTION OF THE PREFERRED EMBODIMENT

Below some embodiments of the present invention are explained. In these embodiments, like numbers are used for like elements, in principle.

When a metal mold opening and closing device of a metal mold moving device of the embodiments operates (i.e., when it operates to move a metal cope a small amount relative to a metal drag), clamping means (not shown) may be used to for temporarily fixing a movable frame, as desired. An actuator for moving or rotating the frame (i.e., for moving the metal cope a large amount relative to the metal drag) may preferably be a hydraulic cylinder or an electric cylinder (such as an electric servo-driven cylinder). However, it is not limited to them. If an electric cylinder is used, controlling its speed would be easy and no pressured oil source would be required, causing an advantage in that the entire metal mold casting device of the invention would be compact and easy to use.

By referring to FIGS. 1, 2 and 3, the first embodiment of the invention, i.e., a metal cope moving device and a metal mold casting device, will be explained in detail. In this embodiment the metal mold casting device is a low pressure die casting device.

Figure 1:
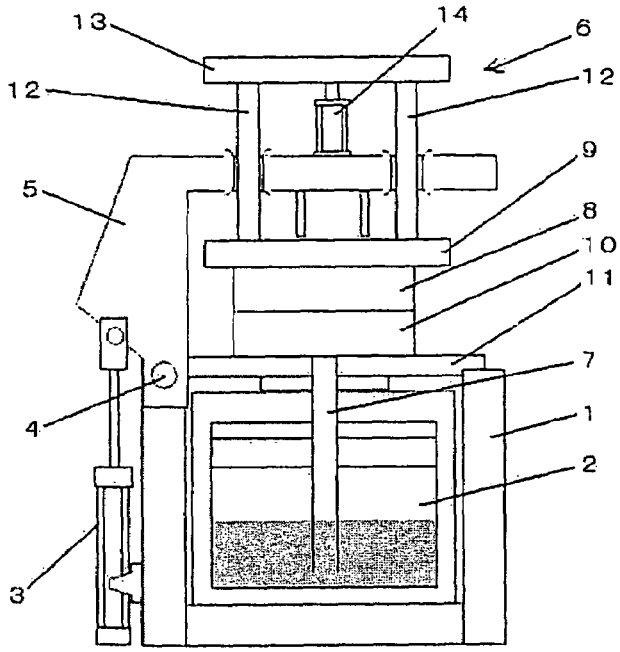
FIG. 1 is a partially cross-sectional view of a first embodiment of the metal mold casting device of the present invention.

As shown in FIG. 1, the low pressure die casting device of the invention comprises a base frame 1; a cope-rotating frame 5 attached to an end of the base frame 1, for rotating about an axis of rotation 4 by the extension and retraction a cope-rotating cylinder 3; and a metal mold opening and closing device 6 for opening and closing a metal mold (i.e., for moving the metal cope towards and apart a small amount from a metal drag). The low pressure die casting device may further include a holding furnace 2 disposed within the base frame 1. The metal mold opening and closing device 6 includes an upwardly-facing actuator (cylinder) 14 secured to the cope-rotating frame 5; and two or four supporting rods 12, 12 connected to the piston rods of the upwardly-facing actuator 14 through a lateral member 13 and vertically slidingly passing through a horizontal portion of the cope-rotating frame 5. These supporting rods 12, 12 at their lower ends carry an upper die plate 9. The upper die plate is designed so that a metal cope 8 is attached to it. A molding cavity that is defined in the metal cope 8 and a metal drag 10 communicates with the holding furnace 2 through a stalk 7. The metal cope 8 is secured to the upper die plate 9, while the metal drag 10 is secured to a lower die plate 11, which is in turn mounted on the base frame 1.

Figure 2:
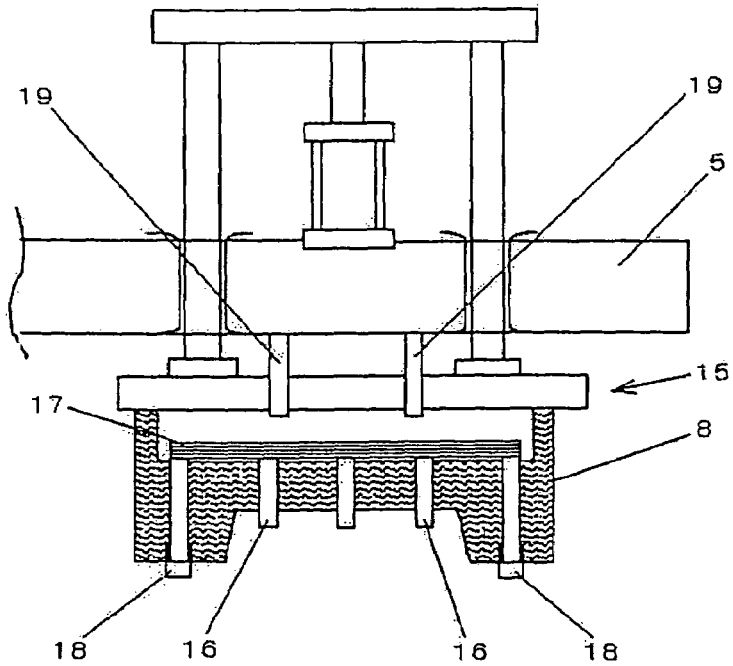
FIG. 2 is an enlarged cross-sectional view of the main part of the device shown in FIG. 1, showing in detail the main part.

As shown in FIG. 2, a pushing mechanism 15 is disposed under the bottom of said horizontal portion of the cope-rotating frame 5, for pushing an as-cast product out of the metal cope 8. The pushing mechanism 15 includes a plurality of pushing pins 16, 16 attached to the metal cope 8, four return pins 18, 18 for pushing up a supporting plate 17 through the metal drag 10, and a plurality of pushing bars (eject pins) 19, 19 secured to the bottom of the horizontal portion of the cope-rotating frame 5 so that the eject pins push down on the supporting plate 17 when the metal cope 8 is moved up.

By referring to FIG. 3, the operation of the device, which is configured as explained above, will be explained. First, at the state shown in stage (a), wherein the cope-rotating frame 5 has been rotated and moved by the actuator (cope-rotating cylinder) 3 to a position that is far from the metal drag (in this embodiment a position that is above and outside the drag), the mold is cleaned, its facing is checked, and a core etc. are set in the mold.

After that setting, the cope-rotating cylinder 3 is extended so as to turn the cope-rotating frame 5 clockwise through 90 degrees as shown in stage (b), so that the metal cope is located in a position that is above and relatively near the metal drag.

The actuator 14 is then retracted to lower the upper die plate and the metal cope so that the metal cope sealingly mates the metal drag, i.e., the mold is clamped, as shown in stage (c). The inner space of the holding furnace is then pressurized under a low pressure to pour molten metal into the molding cavity, as shown in stage (d).

After the molten metal, which has been poured into the molding cavity, solidifies as shown in stage (e), the metal cope opening and closing device 6 operates to move the metal cope 8 up to a level that is suitable for demolding, thereby demolding the mold, i.e., separating the metal cope 8 apart from the metal drag 10, as shown in stage (f). (An as-cast product is separated from the metal drag 10, and it adheres to the cope.) From the state shown in stage (f), the cope-rotating cylinder 3 is retracted to turn the cope-rotating frame 5 counterclockwise through 90 degrees. The resultant state is shown in stage (g).

After turning the cope-rotating frame 5, the actuator 14 of the metal mold opening and closing device 6 is extended, so that the supporting plate 17 is pushed by the pushing bars 19, 19 as shown in stage (g), to push the as-cast product out of the metal cope by using the pushing pins 16, 16.

The as-cast product pushed out of the metal cope is then received and transferred to another place manually or by a particular takeout device. Thus one cycle of casting a product (a metal mold) has been completed. Thus the state of the operation returns to stage (a).

Although in the embodiment the cope-rotating frame 5 of the device is rotated through 90 degrees when an as-cast product is taken out, the device may be arranged so that the frame 5 is rotated through 90 to 180 degrees to take out the as-cast product.

Figure 4:
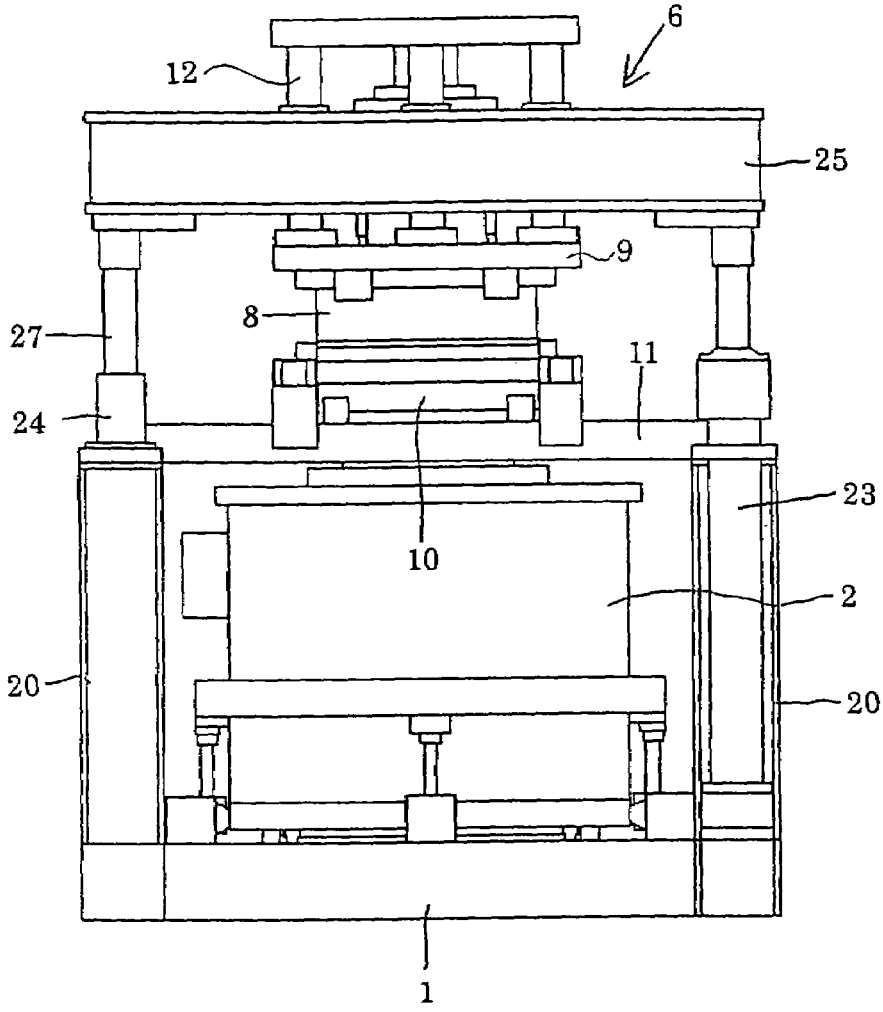
FIG. 4 is a front view of a second embodiment of the metal mold casting device of the present invention.
Figure 5:
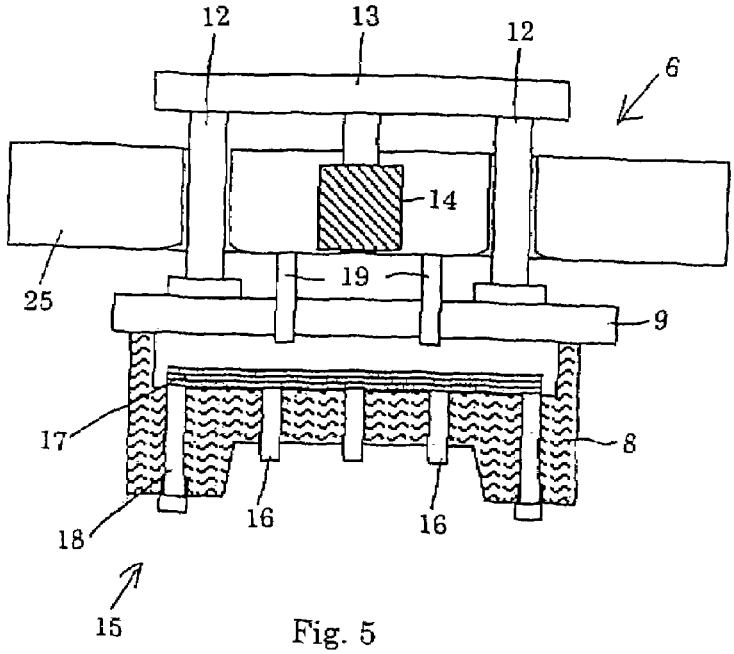
FIG. 5 is an enlarged cross-sectional view of the main part of the device shown in FIG. 4, showing in detail the main part.
Figure 6:
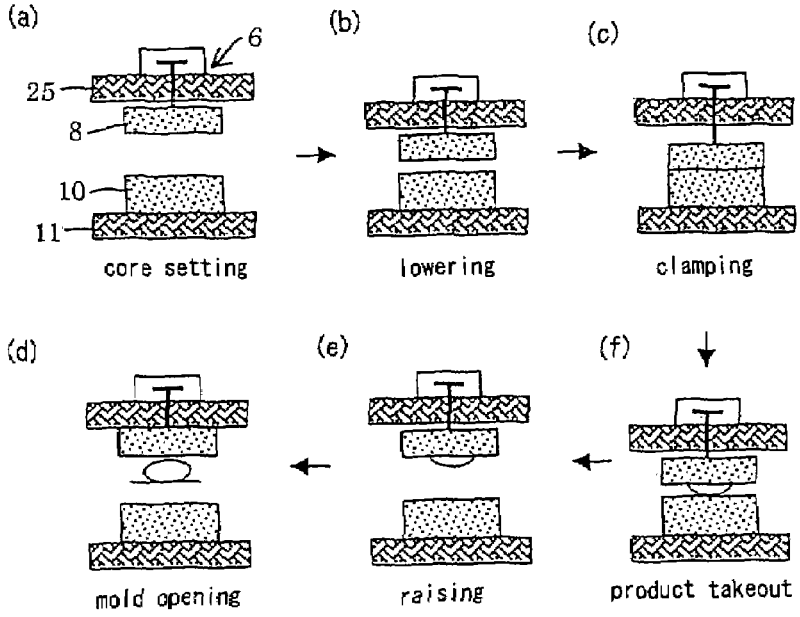
FIG. 6 is an explanatory drawing for the operation of the device shown in FIGS. 4 and 5.

Next, by referring to FIGS. 4-6, the second embodiment of the metal mold casting device of the invention is explained in detail. This embodiment is also relates to the low pressure casting as in the first embodiment.

The metal mold casting device shown in FIG. 4 includes a base frame 1; a holding furnace 2 disposed on the central part of the base frame 1; four upright supports 20, 20 mounted on the base frame 1 at it four corners; a lower die plate 11 mounted on the upper ends of the four upright supports 20, 20; two actuators (in this embodiment, two upwardly-facing hydraulic cylinders) 23, 23 attached to two of the four upright supports that diametrically face, respectively; a horizontal frame 25 mounted, for vertical movement, on the piston rods of the two upwardly-facing hydraulic cylinders 23, 23; two upright guide rods 27, 27 slidingly mounted through holders 24 in two remaining upright supports 20, 20 of the four upright supports 20, 20 and connected at their upper ends to the bottom of the horizontal frame 25; and an metal mold opening and closing device 6 mounted on the central part of the horizontal frame 25 for carrying and moving the metal cope 8 relative to a metal drag 10 so that they mate or are spaced apart.

A molding cavity defined in the metal cope and drag communicates with the holding furnace 2 through a stalk (such as stalk 1 shown in FIG. 1, but not shown in FIG. 4). The metal drag 10 is secured to an upper die plate 11, while the metal cope 8 is secured to an upper, rectangular die plate 9, which is in turn secured to the metal mold opening and closing device 6. As is shown in FIG. 5, the metal mold opening and closing device 6, which includes the upper die plate 9 to which the metal cope 8 is secured, further includes four supporting rods 12, 12 mounted on the upper die plate 9 and vertically extending to pass through the horizontal frame 25, a lateral member 13 mounted on the four supporting rods 12, 12, and an upwardly-facing actuator 14 mounted on the central part of the horizontal frame 25. The actuator 14 has a piston rod with its upper end being secured to the bottom of the lateral member 13, for vertically carrying the upper die plate 9.

Further, a pushing mechanism 15 for pushing as-cast product shown in FIG. 5 is the same as that shown in FIG. 2 and includes the elements denoted by numbers 16, 17, 18, and 19, as in FIG. 2.

In the operation of the device designed as explained above, the actuator 14 of the metal mold opening and closing device 6 is extended to move the metal cope 8 up by a small stroke for a small amount of movement, and the two hydraulic cylinders 23, 23 are extended to move the metal mold opening and closing device 6 and the metal cope 8 up by a large stroke for a large amount of movement as shown in stage (a) of FIG. 6, thereby proving a working space between the metal cope 8 and drag 10 for taking out an as-cast product and for setting a core. The desired core is then set in the metal drag 10. As shown in stage (b), the two hydraulic cylinders 23, 23 are then retracted to move the metal mold opening and closing device 6 and the metal cope 8 down to a position that is above and near the metal drag 10 the same in the first embodiment, and the actuator 14 is then retracted to allow the metal cope 8 to mate the metal drag 10, as shown in stage (c).

The molten metal held within the holding furnace 2 is then pressurized, so that it is poured into the mold (the metal cope 8 and drag 10) through the stalk. After the metal in the mold solidified, the actuator 14 is extended by a specified distance to separate and move the cope 8 up from the drag 10 with the as-cast product adhering to the cope 8 as shown in stage (d). During this operation, since the two hydraulic cylinders 23, 23 are being retracted, and since the structure made up of the horizontal frame 25, the two hydraulic cylinders 23, 23, and the two guide rods 27, 27, is supported by a stable structure made up of the four supports 20, 20 and the lower die frame 11, the entire device is stable. Further, since the upper die plate 9 for moving the metal cope 8 is supported by the supporting rods 12, 12, which are relatively spaced apart a short distance from each other, and since these supporting rods are slidably guided in the horizontal frame 25, the metal cope 8 is held horizontal when it is separated from the drag 10.

As is shown in stage (e), the two hydraulic cylinders 23, 23 are then extended to move the horizontal frame 25, the metal mold opening and closing device 6, and the metal cope 8 up, thereby providing a working space for taking out the product and for setting a core. The actuator 14 is then further extended to push the pushing pins 16, 16 of the pushing mechanism 15 down by the pushing bars 19, 19, thereby pushing as-cast product out of the metal cope 8 as shown in stage (f). Thus one cycle of casting a product (a metal mold) has been completed.

In both the first and second embodiments the molten metal in the holding furnace is pressurized for pouring. However, it is not limited to that method to supply molten metal from the holding furnace into the mold. For example, instead of pressuring the inner space of the holding furnace the molding cavy of the mold is evacuated to suck the molten metal up into the cavity.

Figure 7:
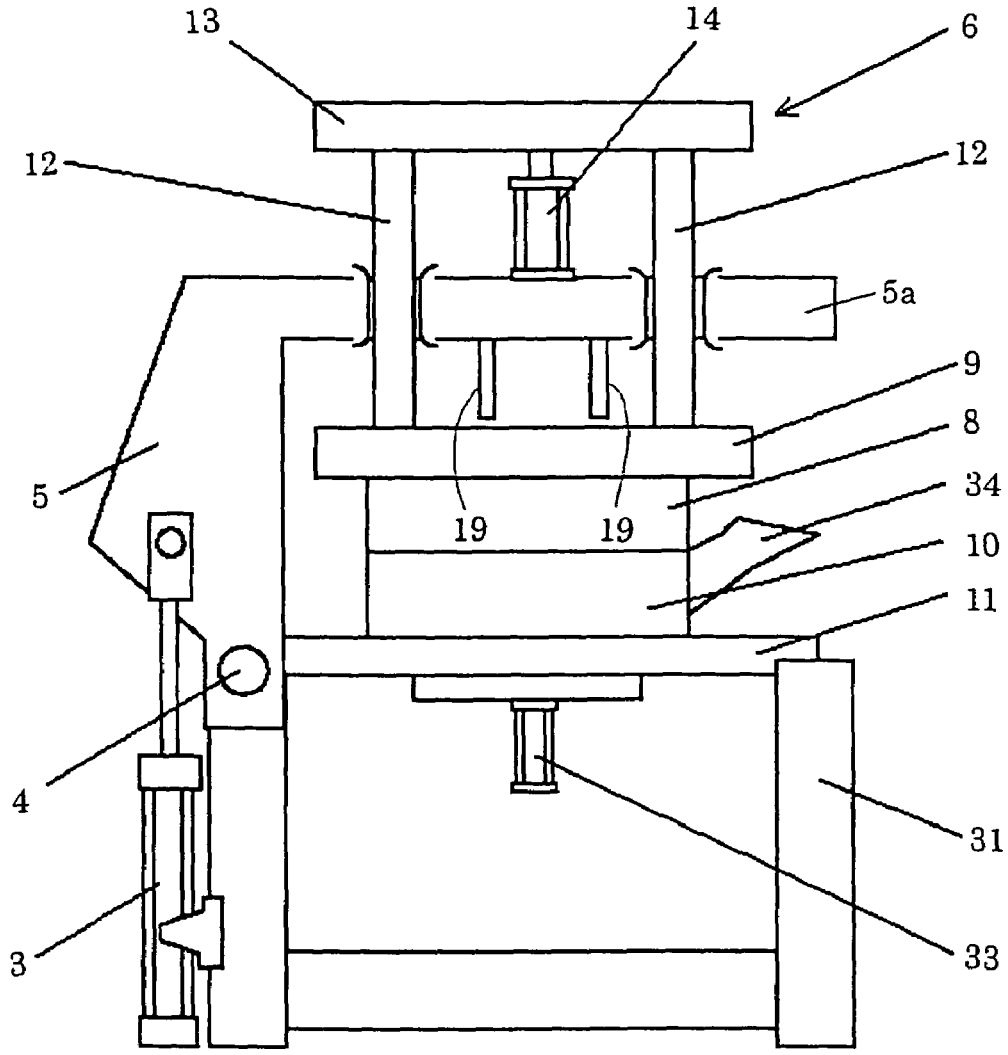
FIG. 7 is a front view of a third embodiment of the metal mold casting device of the present invention.

Next, a third embodiment of the metal mold casting device is explained in detail by referring to FIGS. 7 and 2. In this embodiment the device is a gravity die casting device where the molten metal is introduced into the mold by gravitation.

As shown in FIG. 7, the gravity die casting device of the third embodiment includes a base frame 31; a cope-rotating frame 5 mounted on an end of the base frame 31 for rotating about an axis of rotation 4 by the extension and retraction of a cope-rotating cylinder 3; and a metal mold opening and closing device 6 for opening or closing a mold (a metal cope 8 and a metal drag 10) by the extension and retraction of an actuator 14 mounted on a horizontal portion 5*a* of the cope-rotating frame 5 at a position above the mold.

The metal mold opening and closing device 6 includes an upper die plate 9 that carries the metal cope 8; two or four upright supporting rods 12, 12 mounted on the upper die plate 9 and vertically passing through the horizontal portion 5*a* of the cope-rotating frame 5; a lateral member 13 mounted on the supporting rods 12, 12; and an upwardly-facing actuator 14 mounted on the horizontal portion 5*a* of the cope-rotating frame 5. The end of the piston rod of the upwardly-facing actuator 14 is secured to the bottom of the lateral member 13.

A supply means 34 is attached to a side of the drag 10 for supplying molten metal by gravitation into the molding cavity defined by the mated cope and drag. Further, a pushing cylinder 33 is mounted on the bottom of a lower dies plate 11 for vertically moving pushing pins (not shown) for pushing an as-cast product (not shown) in the metal drag 10.

Except for the pushing cylinder 33 and the gravity-type supply means 34, which is used instead of the holding furnace 2 of FIG. 1, the device of FIG. 7 is the same as the device shown in FIGS. 1 and 2. Accordingly, the device of FIG. 7 includes the pushing mechanism 15 of FIG. 2, which is provided with pins 16, 18, and 19. A further explanation for the mechanism 15 is omitted here, since an explanation is once made above.

Further, the device shown in FIG. 7 can be operated in a manner similar to the operation (shown in FIG. 3) of the device shown in FIGS. 1 and 2. The operation of the device in FIG. 7 is briefly explained below The operation begins from the state shown in stage (a) of FIG. 3. During this stage, which provide an enough working space, the mold is cleaned, the coating is checked, and setting a core, etc. are carried out.

After these are carried out, the cope-rotating cylinder 5 is extended to turn the cope-rotating frame 5 clockwise through 90 degrees.

The actuator 14 is then retracted to lower the upper die plate to sealingly mate the metal cope 8 with the metal drag 10 for clamping them. By using a pouring machine or a ladle, molten metal is then introduced into the molding cavity for casting through the supplying means 34.

During this introduction of the molten metal, the body of the device, including the cope-rotating frame 5, the metal cope 8, and the metal drag 10, may be inclined.

After the molten metal in the molding cavity hardened, the upper die plate is moved up to a specified level to separate the cope 8 from the drag 10, with the as-cast product being separated from the drag 10 and adhering to the cope 8.

The cope-rotating cylinder 3 is then retracted to turn the cope-rotating frame counterclockwise through 90 degrees.

Figure 3:
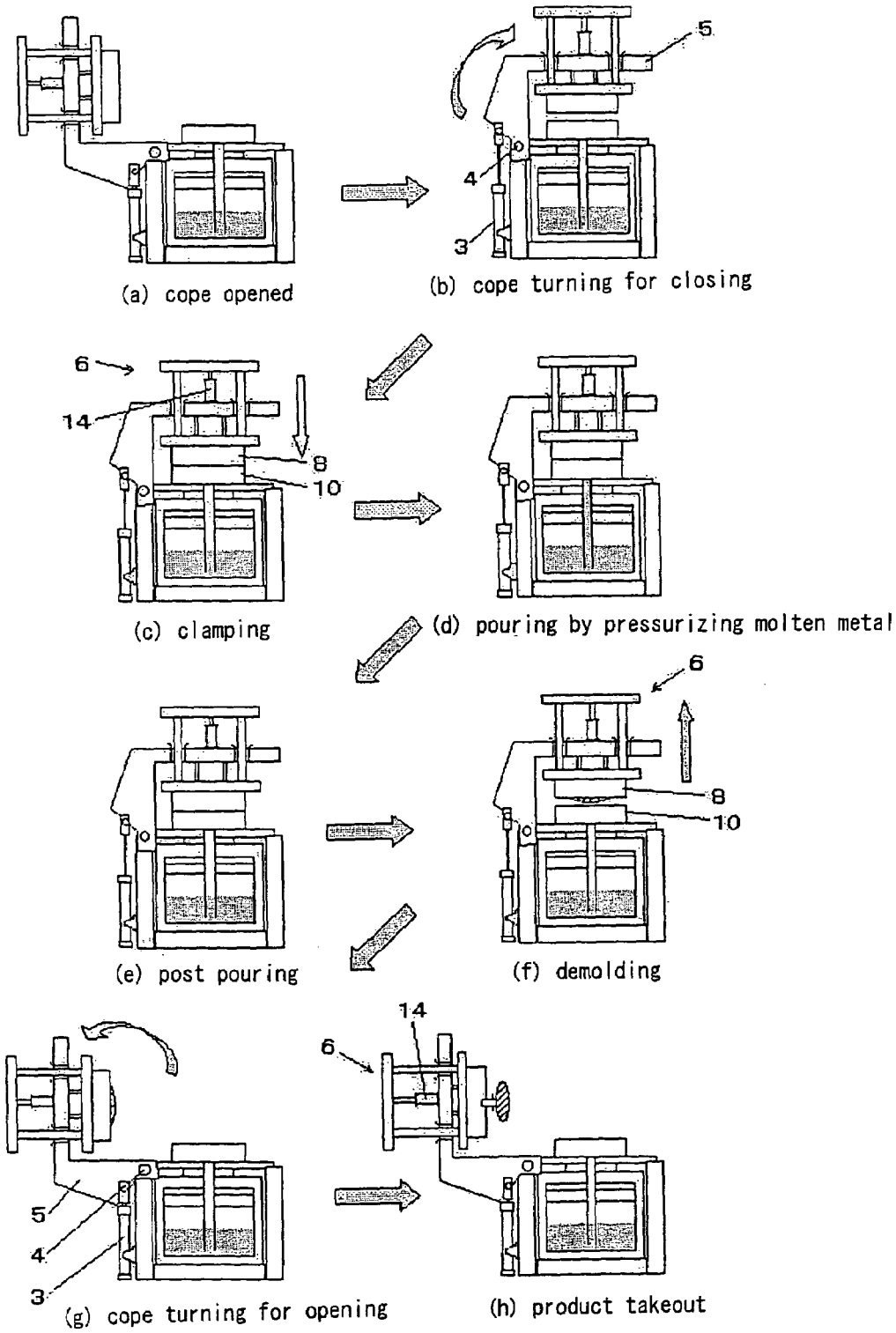
FIG. 3 is an explanatory drawing for the operation of the device shown in FIGS. 1 and 2.

After it, the actuator 14 of the metal mold opening and closing device 6 is extended to further move the cope 8 the same as explained in FIG. 3, thereby allowing the supporting plate 17 to contact with the pushing bars 19, 19, so that the as-cast product is taken out of the metal cope by the pushing pins 16, 16.

The taken-out product is received and transferred to another place manually or by a special takeout machine. Thus one cycle for producing a cast, or a metal mold, is completed.

In a variation the device may be arranged so that the cope-rotating frame 5 is tuned through 90 to 180 degrees, and the cast may be taken out upwardly.

Although in this embodiment the cast is first separated from the drag 10 and adheres to the cope 8 and then removed from the cope 8, it may be first separated from the cope 8 and adhere to the drag 10 and then removed from the drag by using the pushing cylinder 33 and the pushing pins attached to the drag 10.

The three embodiments of the invention are explained above. It is clear to one skilled in the art that variations and changes in those embodiments will be made without departing from the sprit and the scope of the invention. Accordingly, this invention intends to include such variations and changes, and the scope of the invention will be defined by the accompanying claims.

The invention claimed is:

1. A device for moving a metal cope towards and apart from a stationary metal drag, used in a metal mold casting device that uses the metal cope and metal drag, comprising:

an upper die plate for carrying the metal cope;

a frame;

a single upwardly-facing cylinder mounted on the frame for carrying and vertically moving the upper die plate relative to the frame so as to move the metal cope attached to the upper die plate between a first position that is above and relatively near the metal drag and a mold-closing position that is at the metal drag; and an actuator connected to the frame for moving the frame so as to move the metal cope attached to the upper die plate between the first position and a second position that is relatively far from the metal drag;

wherein the single upwardly-facing cylinder is connected to the upper die plate through a lateral member and a plurality of vertical supporting rods suspended from the lateral member and slidingly passing through the frame guide vertical movement of the upper die plate.

2. The device of claim 1, wherein the actuator operates to allow the frame to rotatably move.

3. The device of claim 1, wherein the actuator includes a plurality of upwardly-facing cylinders for vertically moving the frame.

4. A metal mold casting device that uses a metal cope and a metal drag, comprising:

a stationary metal drag;

a metal cope movable towards and apart from the metal drag, said metal cope defining a molding cavity in the metal cope and drag when mating with the metal drag; and the device of claim 1.

5. The metal mold casting device of claim 4, wherein at least one of the metal cope and the metal drag is connected to means for supplying molten metal to the molding cavity, and wherein the means for supplying molten metal is a gravity-type supply means or a low-pressure-type supply means.

6. The device of claim 1, further including eject pins for pushing an as-cast product out of at least one of the metal cope and the metal drag.

7. The metal mold casting device of claim 4, further including eject pins for pushing an as-cast product from at least one of the metal cope and the metal drag.

* * * * *